US006967630B2

(12) United States Patent
Tada

(10) Patent No.: US 6,967,630 B2
(45) Date of Patent: Nov. 22, 2005

(54) EXTERNAL ANTENNA

(75) Inventor: Nobuyuki Tada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 11 days.

(21) Appl. No.: 10/816,191

(22) Filed: Apr. 2, 2004

(65) Prior Publication Data

US 2004/0257295 A1 Dec. 23, 2004

(30) Foreign Application Priority Data

Apr. 2, 2003 (JP) ..... 2003-099621

(51) Int. Cl.[7] ..... H01Q 21/00
(52) U.S. Cl. ..... 343/867; 343/742; 360/132
(58) Field of Search ..... 343/702, 742, 343/866, 867; 360/69, 132

(56) References Cited

U.S. PATENT DOCUMENTS 6,304,416 B1 10/2001 McAllister
6,668,141 B2 * 12/2003 Kojima et al. ..... 399/27
6,702,215 B2 * 3/2004 Stamm et al. ..... 242/348
6,743,101 B2 * 6/2004 Leifer et al. ..... 463/39
6,832,056 B2 * 12/2004 Watanabe et al. ..... 399/12
6,856,486 B2 * 2/2005 Onmori et al. ..... 360/132
6,865,047 B2 * 3/2005 Maekawa et al. ..... 360/69
6,878,066 B2 * 4/2005 Leifer et al. ..... 463/39
6,898,380 B2 * 5/2005 Takiguchi ..... 399/12

FOREIGN PATENT DOCUMENTS

JP 11-339436 A 12/1999
JP 2002-140879 A 5/2002

* cited by examiner

*Primary Examiner*—Shih-Chao Chen
(74) *Attorney, Agent, or Firm*—Sughrue Mion, PLLC

(57) ABSTRACT

A cartridge memory is diagonally placed so that two sides of a loop antenna of the cartridge memory are adjacent to two neighboring surfaces of a cartridge case. An external antenna has two tip portions adjacent to these two surfaces. Such an external antenna can enhance communication with a cartridge memory diagonally placed within a magnetic tape cartridge.

8 Claims, 7 Drawing Sheets

EXTERNAL ANTENNA

BACKGROUND ARTS

1. Field of the Invention

The present invention relates to an external antenna which transmits data to and receives data from a non-contact integrated circuit (hereinafter sometimes referred to as "non-contact IC") placed within a case. This application is based on Japanese Patent Application No. 2003-099621 filed on Apr. 2, 2003, and the content of which is incorporated by reference.

2. Description of the Prior Art

In recent years, various products to which a non-contact IC (integrated circuit) is applied have been put into a market. As an example, a magnetic tape cartridge having a cartridge memory with a non-contact IC built therein can be mentioned. Information within the cartridge memory provided within the magnetic tape cartridge is used in various external apparatuses such as a tape drive and a robot hand within a library and, thus, techniques which make it possible to be accessed with the tape cartridge memory in a multi-direction have hitherto been developed.

As such techniques, a technique has been known in which a rectangular cartridge memory wherein a loop-shaped antenna (hereinafter referred to as "loop antenna") is formed on the outer circumference is slanted 45° relative to the bottom surface or where two sides of the loop antenna approach two sides of the cartridge case by slanting the loop antenna 45° relative to the bottom surface (for example, see Japanese Patent Laid-Open No. 2002-140879, and Japanese Patent Laid-Open No. 11-339436). In such a technique, the data is exchanged by a loop shaped external antenna provided on a flat portion of an external device coming close to either of the two sides of the tape cartridge.

However, in the prior art techniques, since only one side of the loop antenna in the external antenna contributes to transmission/receiving with the loop antenna formed on the cartridge memory, it has been difficult to make communication quality good. Specifically, as shown in FIG. 7, at a portion near one side 61 of a substantially rectangular loop antenna 6, which is an-external antenna, a magnetic field becomes parallel to a cartridge memory CM, which is diagonally placed, making it difficult to obtain binding of the magnetic field, as a result, communication cannot be performed. On the other hand, at a portion opposite one side 62 (Range A in the figure), the magnetic field becomes perpendicular to the cartridge memory CM, binding of the magnetic field required for communication can be obtained, and thus, only the side 62 contributed to transmission/receive to the cartridge memory CM in the conventional techniques. For this reason, when such a plane type loop antenna 6, which is the external antenna, is used, the position of transmission/receiving with the cartridge memory CM is restricted, and there is also the problem that the efficiency is reduced by half. Particularly, when being communicated with a magnetic tape cartridge memory in the state where a magnetic tape cartridge is accommodated within a housing case, since a distance between the external antenna and the cartridge memory becomes large, the communication quality thereof has been desired to be enhanced.

An object of the present invention is to provide an external antenna which can enhance communication with a cartridge memory diagonally placed within a magnetic tape cartridge.

SUMMARY OF THE INVENTION

According to the present invention, there is provided an external antenna which performs transmission/receiving with a non-contact type memory diagonally placed within a case in such a manner that a loop antenna of the non-contact type memory is adjacent to neighboring two surfaces of the case, the external antenna comprising a loop antenna having a route adjacent to said two surfaces.

The term "non-contact type memory" used herein comprises a loop antenna formed around an outer circumference and IC tip (integrated circuit), and makes a communication in a non-contact manner to an external antenna or through an electric wave or electromagnetic induction.

According to an aspect of the present invention, when communication is performed with a non-contract type memory diagonally placed in a case, first, an external loop antenna is moved so as to approach corner portions made by two planes of the case, where two portions of a loop antenna of the non-contact memory are adjacently placed. Then, out of the external loop antenna two portions approach the two portions of the loop antenna, respectively. This makes two portions of the external antenna more surely coupled to the two portions of the loop antenna of the non-contact memory, respectively, with an improved communication quality.

In the present invention, the antenna adjacent to these two surfaces is a part of a substantially L-shaped loop antenna.

According to this configuration, only when a conventionally used loop antenna is bent into an L-shape, an antenna adjacent to these two surfaces can be formed. Consequently, a power required for transmitting data to the external antenna or receiving data from the external antenna can be reduced to a level not higher than the conventional electric power. Also, in this case, a transmission/receiving range (distance) can be widened.

Furthermore, according to the present invention, when three portions of the loop antenna of the non-contact type memory are provided so as to be adjacent to three surfaces of the case, one portion of the L-shaped loop antenna is in a substantially straight shape to be in adjacent to these three surfaces.

According to this configuration, when being communicated with a non-contact type memory diagonally placed within the case, first the L-shaped external antenna approaches so as to cover the corner portion. When the external antenna approaches the case as described above, two sides positioned at the tips of the L-shape and one side, which is a substantially straight line, are adjacent to three portions of the loop antenna in the case. Consequently, since the communication between the non-contact type memory and the external antenna are performed at three portions, the communication quality is much more enhanced.

Also, the present invention is characterized in a communication method of an external antenna with a non-contact type memory diagonally placed within a case. Specifically, the present invention relates to a communication process for communicating an external antenna with a non-contact type memory diagonally placed within a case in such a manner that a loop antenna is adjacent to neighboring two surfaces of the case, wherein data communication is performed by pacing the external antenna so that two portions of the antenna are adjacent to these two surfaces at the time of communication.

DESCRIPTION OF THE PREFERRED EMBODIMENTS

[First Embodiment]

Figure 1:
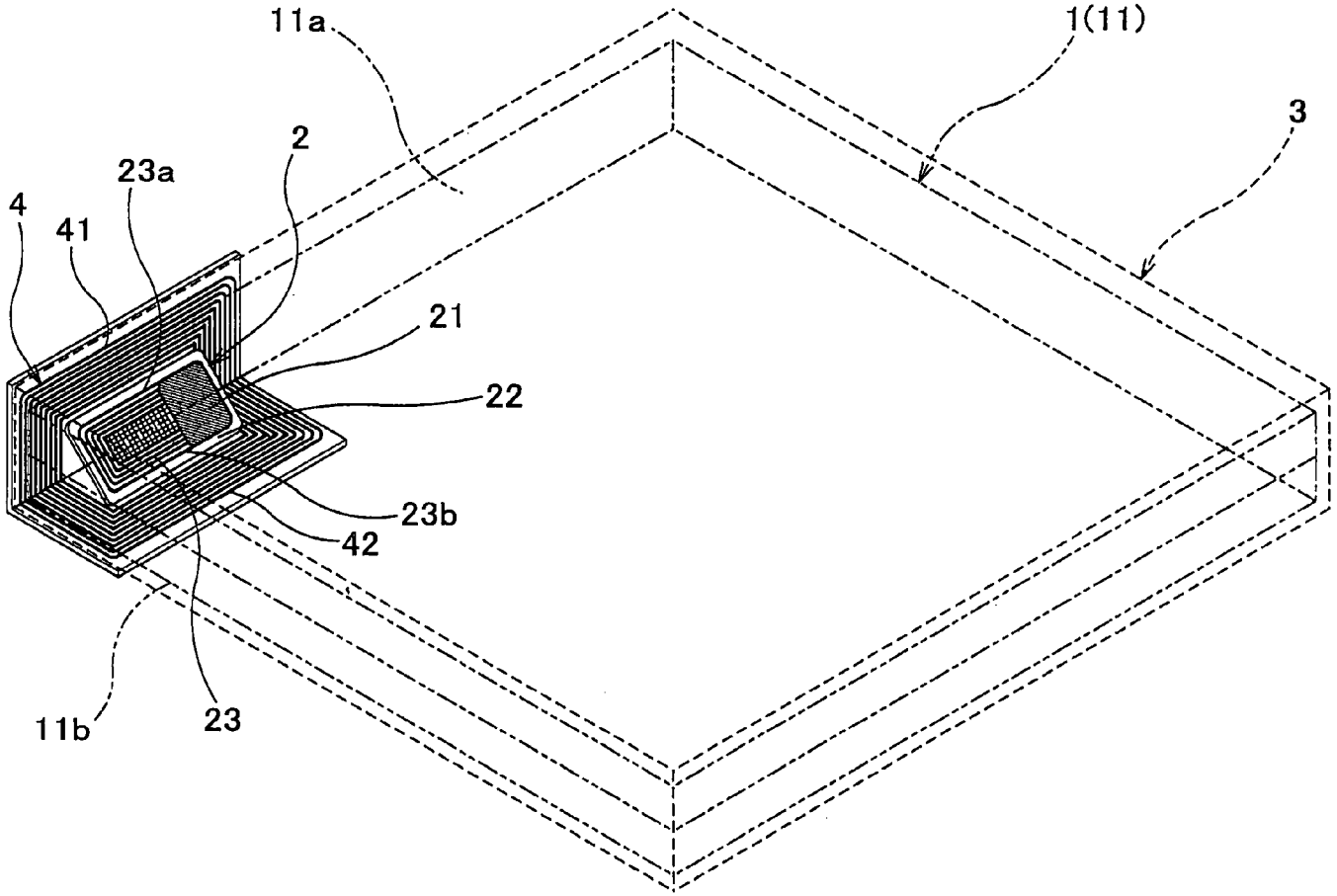
FIG. 1 is a perspective view showing an external antenna according to the first embodiment of the present invention.

First embodiment of the present invention will be described by referring to the drawings.

Figure 2A:
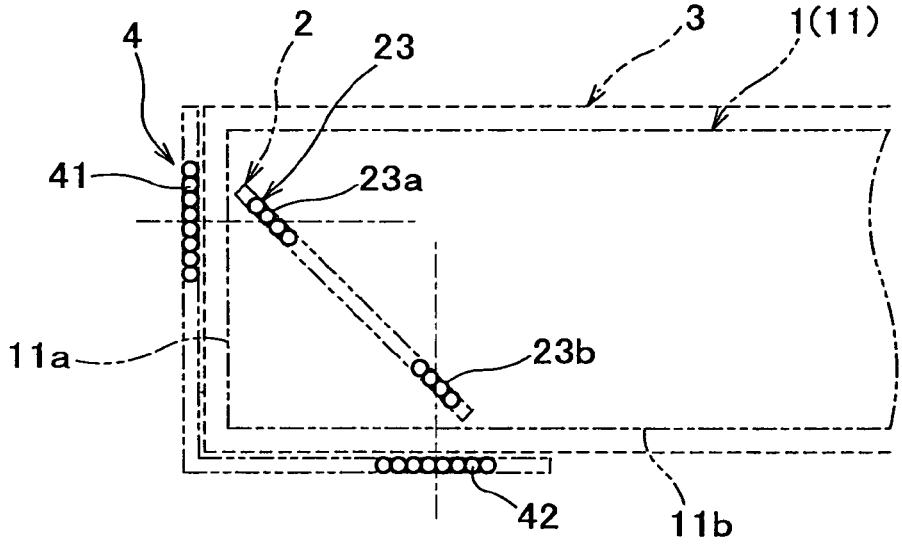
FIG. 2A is a cross-sectional view showing a relation between an external antenna and a cartridge memory.
Figure 2B:
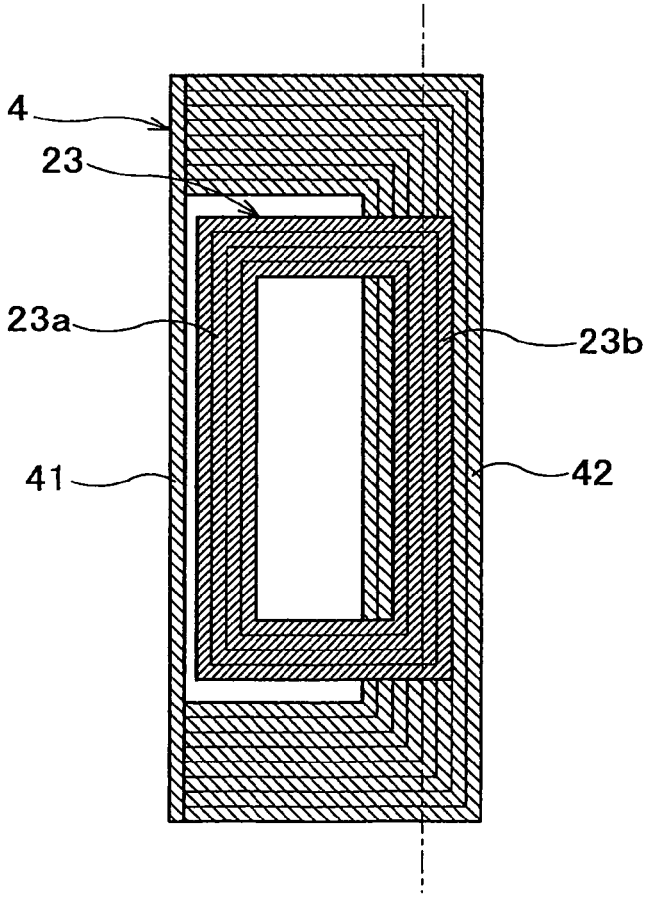
FIG. 2B is a top view showing a relation between an external antenna and a cartridge memory.

FIG. 1 is a perspective view showing an external antenna according to the first embodiment of the present invention, FIG. 2A is a cross-sectional view showing a relation between an external antenna and a cartridge memory, and FIG. 2B is a top view showing a relation between an external antenna and a cartridge memory.

As shown in FIG. 1, a magnetic tape cartridge 1 is composed of a vertically divided cartridge case 11 having a magnetic tape (not shown) for recording data, a cartridge memory (non-contact type memory) 2 and the like accommodated therein. The magnetic tape cartridge 1 is stored in a housing case 3 made of a plastic or such at the product state at the time of shipment. In the product state, in order to manage the magnetic tape cartridge 1, data communication (transmission/receiving) is made between the cartridge memory 2 within the magnetic tape cartridge 1 and an external antenna 4.

The cartridge memory 2 is an electric part, the entirety of which is in a substantially rectangular, thin piece state. The cartridge memory 2 is composed of a main body comprising an IC tip (integrated circuit) (not shown) sealed in a glove top 21, which is sealing agent made of a resin, the IC tip being wired to a loop antenna 23 printed on a substrate 22. The loop antenna 23 has a substantially rectangular shape by winding a lead line around an outer circumference of the cartridge memory 2 several times. The cartridge memory 2 is diagonally placed at approximately 45° relative to a bottom 11*b* so that long side portions 23*a* and 23*b*, which are opposite two sides amongst sides making up the rectangular shape are adjacent to a side surface 11*a* and bottom surface 11*b*, which are two neighboring surfaces of the cartridge case 11.

The external antenna 4 is formed by bending a conductive antenna etched on a flexible substrate in a loop state into a substantially L-shape. By the formation of the external antenna 4 as described above, when the external antenna 4 approaches the magnetic tape cartridge 1, two sides 41, and 42 positioned at the tips of the L-shape (hereinafter simply referred to as "tip portions 41 and 42") are adjacent to the side surface 11*a* and the bottom surface 11*b*. Specifically, the external antenna 4 is composed of a loop antenna having the tip portions 41 and 42, which are routes adjacent to these two surfaces 11*a* and 11*b*. Furthermore, when the external antenna is placed at a prescribed position in order to be communicated with the cartridge memory, these tip portions 41 and 42 are formed so as to be substantially parallel to these long side portions 23*a* and 23*b*.

As shown in FIG. 2A and FIG. 2B, the external antenna 4 is formed so that the centers of the tip portions 41 and 42 in the width direction are accorded with the centers of the long side portions 23*a* and 23*b* in the width direction, respectively. Furthermore, the tip portions 41 and 42 are formed so that each has a width larger than that of long side portions 23*a* and 23*b*. By forming the tip portions 41 and 42 as just mentioned, the lines of magnetic force generated around the tip portions 41 and 42 surround the long side portions 23*a* and 23*b*. Specifically, the lines of magnetic force generated by the external antenna 4 enter into the loop antenna 23 of the cartridge memory in a larger amount. It is noted that for the convenience of the explanation, FIG. 2 omits the glove top 21 of the cartridge memory and the like in FIG. 1, and only shows the loop antenna 23 and the external antenna 4.

A communication method between the external antenna 4 according to the present invention with the cartridge memory 2 will be described.

Figure 3:
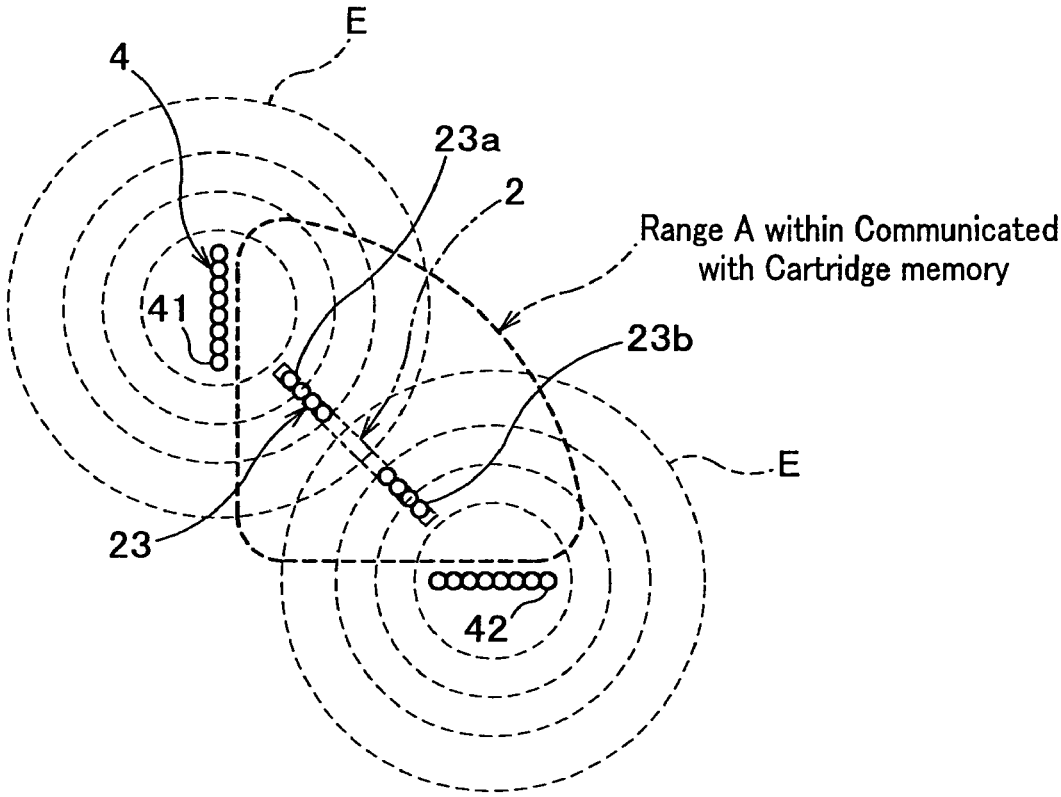
FIG. 3 is a cross-sectional view showing a state of communication between the external antenna and the cartridge memory.

As shown in FIG. 1, first the external antenna 4 approaches two sides 11*a* and 11*b* of the magnetic tape cartridge 1. When the external antenna 4 approaches the housing case 3 having the magnetic tape cartridge 1 accommodated therein, the tip portions 41 and 42 amongst the external antenna 4 approach the long side portions 23*a* and 23*b* of the cartridge memory 2. As shown in FIG. 3, when a signal is running through the external antenna 4 to generate a magnetic field E, communication between these tip portions 41 and 42 and the loop antenna 23 comprising two sides 23*a* and 23*b* of the cartridge memory 2 is performed. In this case, the range A which can be communicated (transmitting/receiving) between the cartridge memory 2 diagonally placed and the external antenna 4 extends from a portion near the tip portion 41 to a portion near the tip portion 42.

As described above, the following advantages can be obtained in the first embodiment:

Since the long side portions 23*a* and 23*b* of the cartridge memory are adjacent to the tip portions 41 and 42 of the external antenna, an amount of the line of magnetic field is increased in comparison with the conventional case, a quality of communication with the cartridge memory 2 diagonally placed can be enhanced. Furthermore, since the communication quality can be enhanced as described above, even in the case where a communication distance between the cartridge memory 2 and the external antenna 4 is increased by accommodating the magnetic tape cartridge 1 within the housing case 3, the management of the magnetic tape cartridge 1 can be carried out in a good manner by effectively utilizing information within the cartridge memory 2.

Since the external antenna 4 can be formed only by bending a loop antenna, a conventionally used plane type loop antenna can be used as it is. Consequently, a power required for transmitting data from the external antenna can be reduced to a level not higher than the conventional electric power. Also, in this case, a transmission/receiving range (distance) can be widened.

[Second Embodiment]

Second embodiment of the present invention will be described by referring to the drawings. Since this is an embodiment in which part of the external antenna 4 according to the first embodiment is altered, the constitution elements similar to those of the first embodiment are assigned to the same symbols and the same numbers, and the detailed description thereof will be omitted.

Figure 4:
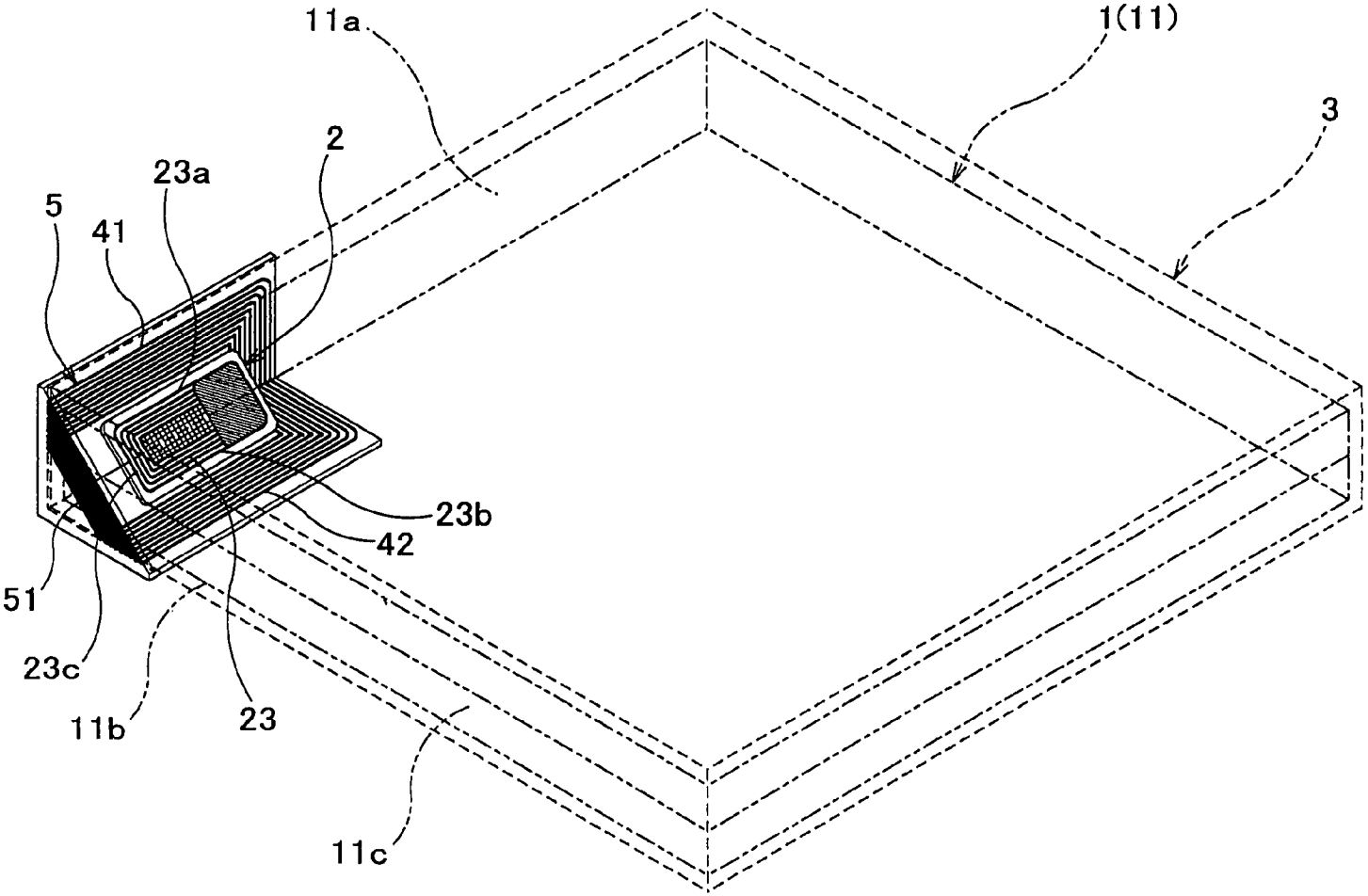
FIG. 4 is a perspective view showing an external antenna according to the second embodiment of the present invention.

As shown in FIG. 4, in an external antenna 5, one of the external antenna 4 according to the first invention having been bent into a substantially L-shape is formed into a substantially straight line as a linear portion 51. The linear portion 51 is formed as a side portion so as to be substantially parallel to a short side portion 23*c* of the loop antenna 23 formed on the cartridge memory 2 diagonally placed within the cartridge case 11.

The cartridge memory 2 is placed in a corner of the cartridge case 11 in such a manner that three sides, i.e., the long side portions 23*a* and 23*b*, and the short side portion 23*c* are adjacent to three sides of the cartridge case 11, i.e., the side surface 11*a* and the bottom surface 11*b*, and a side surface 11*c* perpendicular thereto. The linear portion 51 of the external antenna 5 is formed so that when the external antenna 5 is adjacent to three surfaces 11*a* to 11*c* of the cartridge case 11, the center of the linear portion 51 in the width direction is accorded with the center of the short side portion 23*c* in the thickness direction, and the width of the linear portion 51 formed is larger than the thickness of the short side portion 23*c*. By forming the linear portion 51 as described above, the line of magnetic force generated around the linear portion 51 surrounds short side portion 23*c*, increasing the magnetic line entering in the loop antenna 23.

A communication method between the external antenna 5 according to this embodiment with the cartridge memory 2 will be described.

As shown in FIG. 4, first the external antenna 5 approaches three surfaces 11*a* to 11*c* of the magnetic tape cartridge 1. When the external antenna 5 approaches the housing case 3 having the magnetic tape cartridge 1 accommodated therein, the tip portions 41 and 42, and the linear portion 51 amongst the external antenna 5 approach the long side portions 23*a* and 23*b* and the short side portion 23*c* of the cartridge memory 2. When a signal is running through the external antenna 5 to generate a magnetic field, communication between these tip portions 41 and 42 as well as the linear portion 51 and the loop antenna 23 comprising three sides 23*c* to 23*c* of the cartridge memory 2 is performed.

As described above, the following advantages can be obtained in the second embodiment:

Since three sides 23*a* to 23*c* are adjacent to the tip portions 41 and 42 and the linear portion 51 of the external antenna, the line of the magnetic field passing within the loop antenna 23 is increased in comparison with the conventional case, greatly enhancing the communication quality.

While the embodiments of the present invention have been described, it should be noted the present invention should not be restricted thereto, and various modifications can be made.

(i) While the external antenna 4 is formed by bending a conductive antenna etched on a flexible substrate in a loop state, the present invention is not restricted thereto. For example, the conductive line is once formed into a loop in a plane state, which is then bent, to form the external antenna 4. The external antenna 5 in the second embodiment is also freely produced. For example, it may be produced by winding a conductive line around a pattern having a shape of the external antenna 5.

(ii) In these embodiments, the external antennas 4 and 5 are formed by deforming one loop antenna, but the present invention is not restricted thereto. For example, loop antennas having shapes of the first and second embodiment may be formed by binding a plurality of plane type antennas. Alternatively, a plurality of plane type loop antennas may be provided on a plurality of plane portions perpendicular to each other to approach each surface of the cartridge case 11.

(iii) In these embodiments, the external antennas 4 and 5 are used in an apparatus for managing the magnetic tape cartridge 1 accommodated within the housing case 3, but the present invention is not restricted thereto. For example, these external antennas 4 and 5 may be used in various external apparatuses such as a tape drive and a robot hand within a library.

Figure 5:
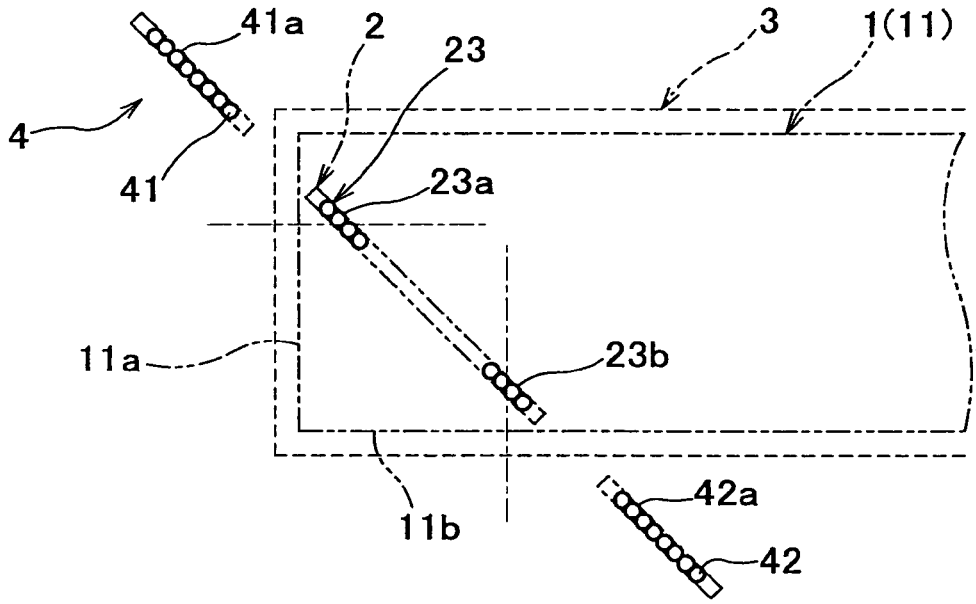
FIG. 5 is a perspective view showing an external antenna according to another embodiment of the present invention.

(iv) In the embodiment, the surfaces of the tip portions 41 and 42 (surfaces formed by the conductive coil) are formed so as to be parallel to the two surfaces 11*a* and 11*b*, but the present invention is not restricted thereto. For example, as shown in FIG. 5, surfaces 41*a* and 42*a* of the tip portions 41 and 42 may be arranged to be parallel to the cartridge memory within the cartridge case 11.

(v) In the embodiment, the external antenna 4 is a rectangular loop antenna, but the present invention is not restricted thereto. For example, by bending a circular loop antenna into a substantially L-shape, a portion contributing to transmitting and receiving with the cartridge memory 2 is formed into a semi-circular shape.

Figure 6:
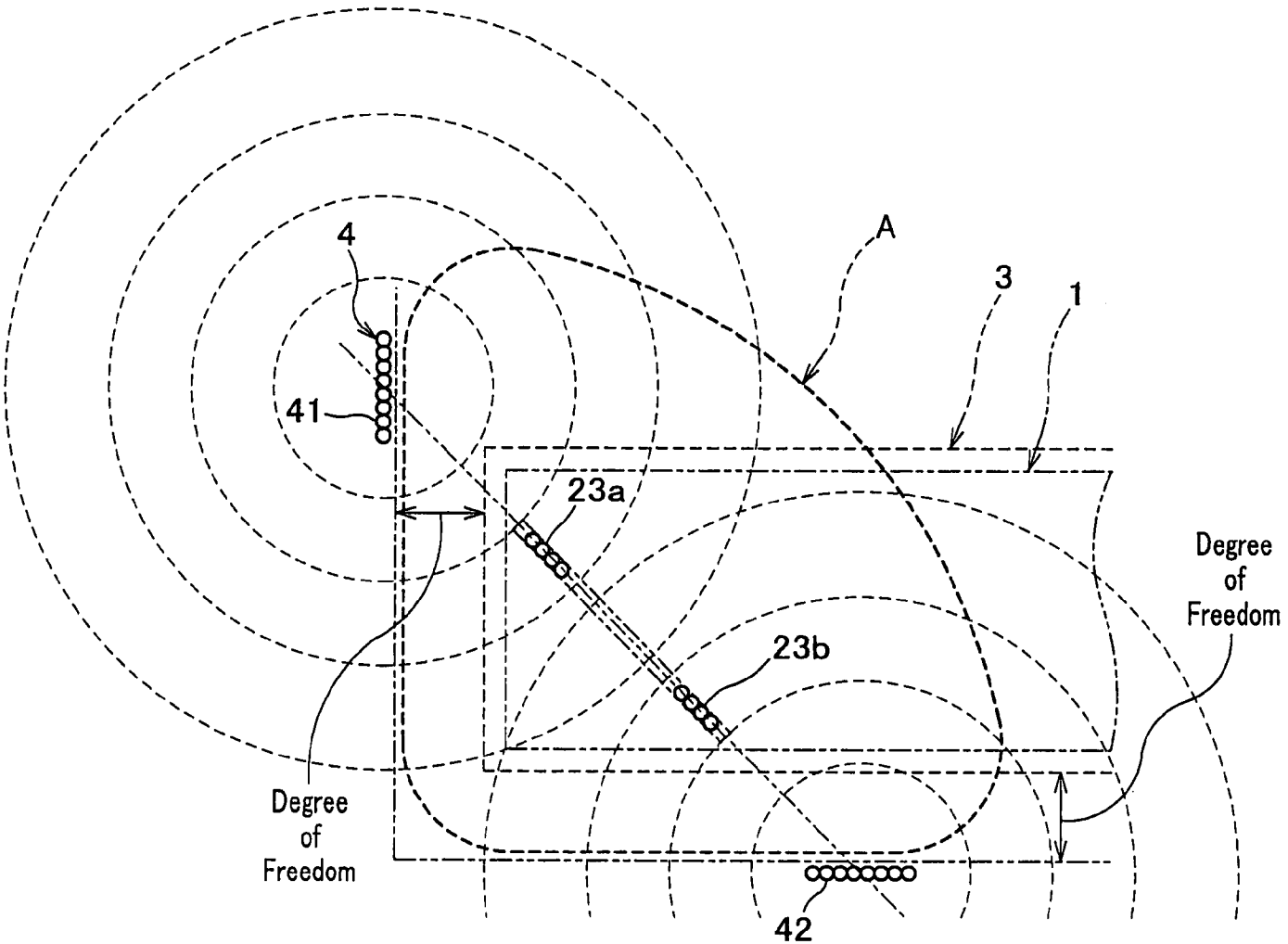
FIG. 6 is a perspective view showing an external antenna according to still another embodiment of the present invention.
Figure 7:
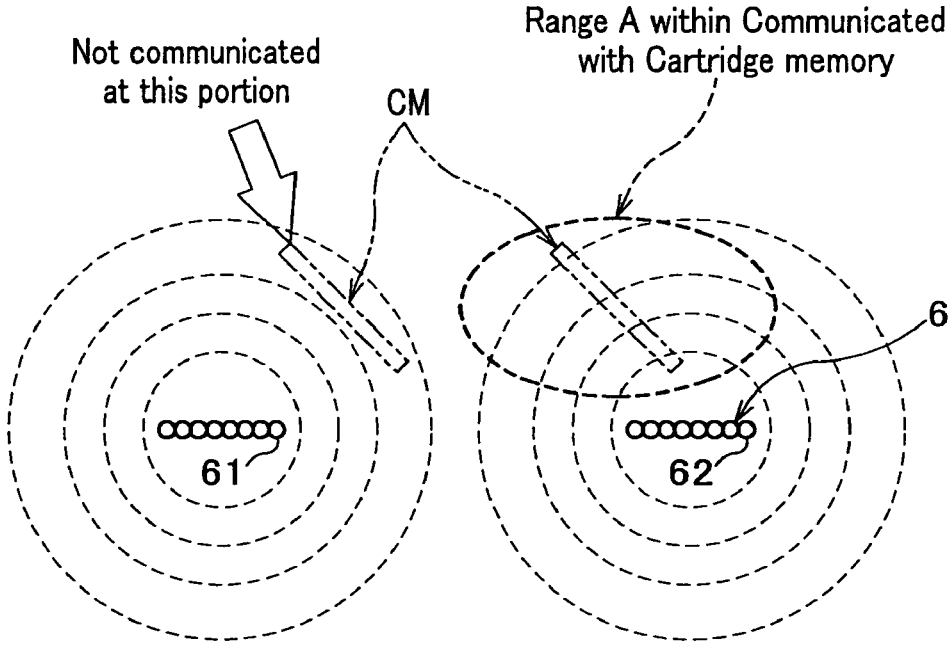
FIG. 7 PRIOR ART
FIG. 7 is a cross-sectional view showing a relation between the conventional external antenna and a cartridge memory.

(vi) The size of the external antenna can be freely set. For example, as shown in FIG. 6, the external antenna 4 is largely formed so that the tip portions 41 and 42 are far from each other, making it possible to enhance the range A which can be communicated, and increasing a degree of freedom in the positional relationship between the external antenna 4 and the cartridge memory 3. Although not shown in figure, for example, longer lengths of the tip portions 41 and 42 (the lengths in the direction perpendicular to the paper) can enhance the range A which can be communicated in the lengthwise direction of the tip portions 41 and 42.

What is claimed is:

1. An external antenna which performs transmission/receiving with a non-contact type memory diagonally placed within a case in such a manner that a loop antenna of the non-contact type memory is adjacent to neighboring two surfaces of the case, the external antenna comprising a loop antenna having a route adjacent to said two surfaces.

2. The external antenna according to claim 1, wherein said external antenna possesses tip portions adjacent to the neighboring two surfaces of the case.

3. The external antenna according to claim 1, wherein said external antenna adjacent to said two surfaces is a part of a substantially L-shaped loop antenna.

4. The external antenna according to claim 1, wherein three portions of the loop antenna of the non-contact type memory are provided so as to be adjacent to three surfaces of the case, and said external antenna comprises a substantially L-shaped loop antenna with a side portion which is in a substantially straight shape, so that the substantially L-shaped loop antenna is adjacent to the three surfaces.

5. The external antenna according to claim 2, which is largely formed so that the tip portions of said external antenna are far from each other.

6. The external antenna according to claim 3, wherein said route comprises tips of the L-shape.

7. The external antenna according to claim 3, which is produced by deforming one loop antenna into an L-shape.

8. A communication process for communicating an external antenna comprising at least two portions with a non-contact type memory diagonally placed within a case in such a manner that a loop antenna is adjacent to neighboring two surfaces of the case, wherein data communication is performed by placing the external antenna so that the at least two portions of the external antenna are adjacent to the neighboring two surfaces at the time of communication.

* * * * *